US011579567B2

(12) United States Patent
Kissling et al.

(10) Patent No.: US 11,579,567 B2
(45) Date of Patent: Feb. 14, 2023

(54) DIAL FOR A UNIVERSAL WATCH

(71) Applicant: Omega SA, Biel/Bienne (CH)

(72) Inventors: Gregory Kissling, La Neuveville (CH); Antonio Ventura, Ecuvillens (CH)

(73) Assignee: Omega SA, Biel/Bienne (CH)

( * ) Notice: Subject to any disclaimer, the term of this patent is extended or adjusted under 35 U.S.C. 154(b) by 514 days.

(21) Appl. No.: 16/794,333

(22) Filed: Feb. 19, 2020

(65) Prior Publication Data

US 2020/0301364 A1 Sep. 24, 2020

(30) Foreign Application Priority Data

Mar. 19, 2019 (EP) ..... 19163830

(51) Int. Cl.
*G04B 19/22* (2006.01)
*G04B 19/06* (2006.01)

(52) U.S. Cl.
CPC ..... *G04B 19/22* (2013.01); *G04B 19/06* (2013.01)

(58) Field of Classification Search
CPC ..... G04B 19/22; G04B 19/06; G04B 19/223; G04B 19/25; G04B 19/221
See application file for complete search history.

(56) References Cited

U.S. PATENT DOCUMENTS 3,472,021 A * 10/1969 Karakawa ..... G04B 19/223 368/185
5,146,436 A * 9/1992 Wright ..... G04B 19/223 368/21
5,383,165 A 1/1995 Vaucher
5,917,778 A * 6/1999 James ..... G04B 19/22 368/17
2006/0171256 A1* 8/2006 Herbert ..... G04C 17/0058 368/21
2010/0214882 A1 8/2010 Bourban et al.
(Continued)

FOREIGN PATENT DOCUMENTS

CH 287290 11/1952
CN 1588240 A 3/2005
(Continued)

OTHER PUBLICATIONS

European Search Report dated Sep. 27, 2019 in European Application 19163830.3 filed Mar. 19, 2019 (with English Translation of Categories of Cited Documents), 4 pages.
(Continued)

*Primary Examiner* — Edwin A. Leon
(74) *Attorney, Agent, or Firm* — Oblon, McClelland, Maier & Neustadt, L.L.P.

(57) ABSTRACT

A dial includes a ring in the form of an annular plate, a central disc mounted in a concentric and essentially coplanar manner with respect to the ring, the diameter of the central disc being less than the internal diameter of the ring so as to form an annular area between the two, and a transparent part which covers the annular area. Further, the transparent part is fixed to the central disc and to the ring to secure these elements to each other. The dial can be used in a timepiece with a universal time display and makes it possible to mount a twenty-four hour disc underneath the dial, and to view the markings on the twenty-four disc through the transparent part.

16 Claims, 3 Drawing Sheets

(56) References Cited

U.S. PATENT DOCUMENTS

| | | | |
|---|---|---|---|
| 2011/0151415 | A1 | 6/2011 | Darling |
| 2019/0018367 | A1 | 1/2019 | Rachdi et al. |

FOREIGN PATENT DOCUMENTS

| | | | |
|---|---|---|---|
| CN | 2692717 | Y | 4/2005 |
| CN | 203250138 | U | 10/2013 |
| CN | 203365946 | U | 12/2013 |
| CN | 204347449 | U | 5/2015 |
| CN | 107817672 | A | 3/2018 |
| CN | 207718152 | U | 8/2018 |
| DE | 1 795 193 | | 9/1959 |
| EP | 3 428 737 | A1 | 1/2019 |
| JP | 55-1754 | U | 1/1980 |
| JP | 62-59888 | A | 3/1987 |
| JP | 6-207989 | | 7/1994 |
| JP | 2000-329864 | A | 11/2000 |
| JP | 2001 -99952 | A | 4/2001 |
| JP | 2007-86027 | A | 4/2007 |

OTHER PUBLICATIONS

Combined Chinese Office Action and Search Report dated Mar. 29, 2021 in Patent Application No. 202010165471.3 (with English language translation and English translation of Category of Cited Documents), 11 pages.

Notice of the Reason for Refusal dated May 6, 2021 in Japanese Patent Application No. 2020-029067 (with English language translation), 8 pages.

* cited by examiner

DIAL FOR A UNIVERSAL WATCH

CROSS-REFERENCE TO RELATED APPLICATION

This application claims priority to European Patent Application No. 19163830.3 filed on Mar. 19, 2019, the entire disclosure of which is hereby incorporated herein by reference.

FIELD OF THE INVENTION

The present invention relates to horology, more particularly to a dial that can be used in a timepiece with a universal time display.

STATE OF THE ART

A universal watch can simultaneously display the current time in different time zones in the world. Such a watch usually comprises a fixed dial, hour and minute hands which are driven and move above the dial in the clockwise direction, at a rate of one revolution in 12 hours and one revolution in 1 hour respectively, a twenty-four hour disc and a disc concentric to the dial and to the twenty-four hour disc bearing the names of the cities or global locations that represent the different time zones. The twenty-four hour disc is connected to the hour hand by a gear, in order to rotate at a rate of one revolution per 24 hours in the anticlockwise direction, the time of a location being indicated by the division of the twenty-four hour disc which is facing said location. In most cases, the dial and the disc bearing the names of the cities are parts that are independent of one another, the dial generally being located at the centre, integral with the movement, and the twenty-four hour disc and the city disc surrounding the central dial in succession and in a coplanar manner. Such a design has the particular drawback of requiring the upper part of the movement to be adapted, in particular in order to arrange the dial.

SUMMARY OF THE INVENTION

It is an object of the present invention to provide a dial which does not suffer from the drawbacks identified above. This object is achieved by a dial according to the annexed claims. The invention also concerns a timepiece, such as a watch, equipped with a dial according to the invention. A dial according to the invention comprises a ring in the form of an annular plate, a central disc mounted in a concentric and essentially coplanar manner with respect to the ring, the diameter of the central disc being less than the internal diameter of the ring to form an annular area between the two, and a transparent part which covers said annular area. Further, the transparent part is fixed to the disc and to the ring to secure these elements to each other. The dial can be used in a timepiece with a universal time display and makes it possible to mount a twenty-four hour disc in a simple way on the movement beneath the dial, and to view the markings on the twenty-four disc through the transparent part.

Specific features and advantages of the present invention will appear in the following description of preferred embodiments, given by way of non-limiting example with reference to the annexed drawings.

DETAILED DESCRIPTION OF EMBODIMENTS OF THE INVENTION

Figure 1:
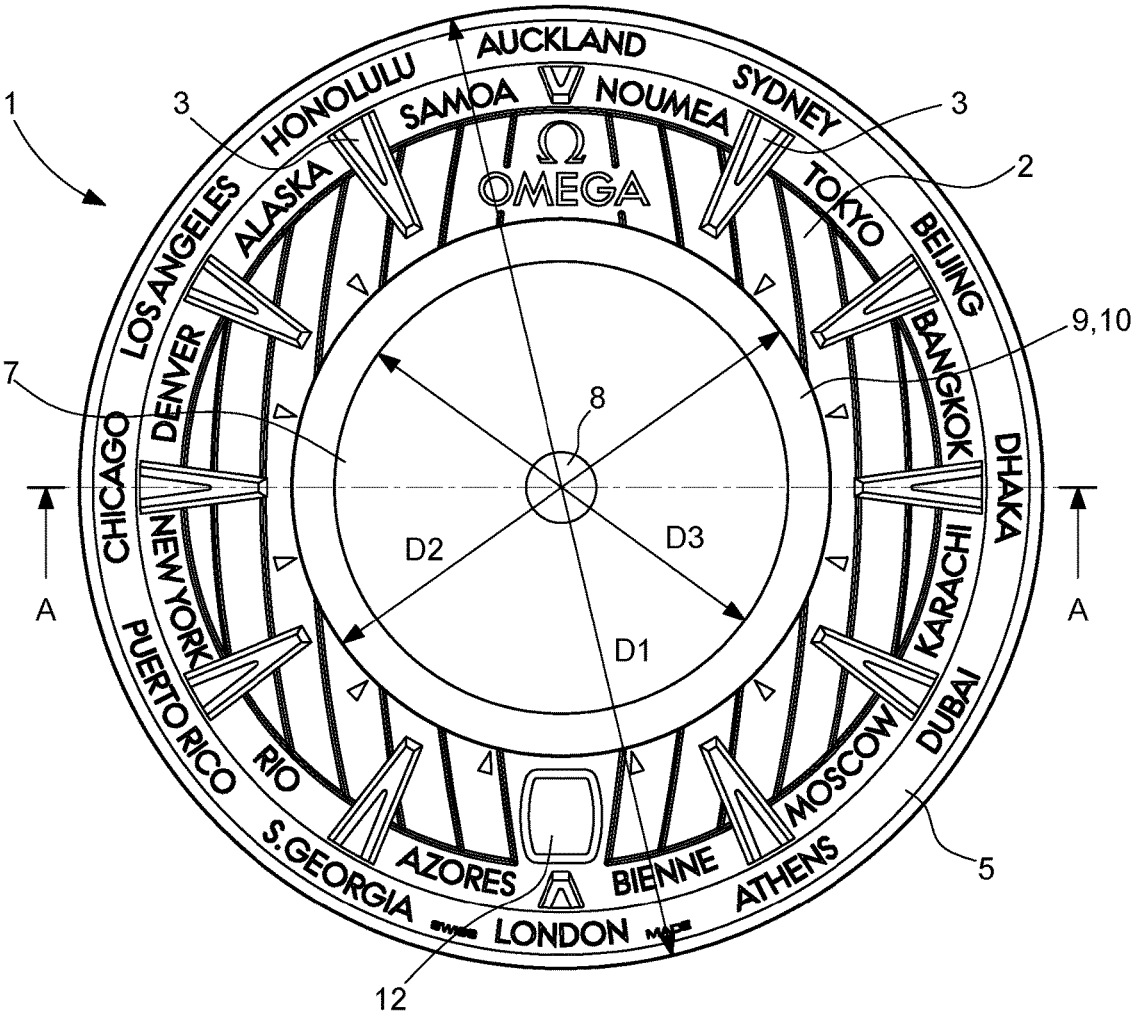
FIG. 1 represents a front view of a watch dial according to an advantageous embodiment of the invention.
Figure 2:
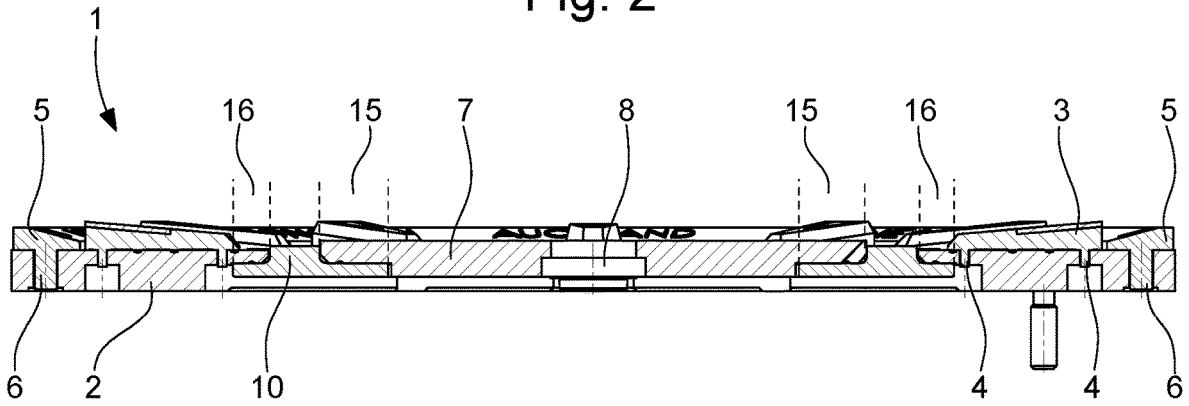
FIG. 2 represents a sectional view along section A-A shown in FIG. 1.

Dial 1 represented in FIGS. 1 and 2 comprises three parts secured to each other to form a single integral part. The dial can be used for a wristwatch. Dial 1 comprises a flat ring 2, preferably made of metal, in the form of an annular plate having an external diameter D1 and an internal diameter D2. In the embodiment of the Figures, ring 2 has twelve indices 3 affixed to the upper surface of ring 2 by mounting feet 4 (see FIG. 2). The 'upper surface' means here the surface intended to be positioned facing the watch crystal and the 'lower surface' means the opposite surface. The positions of indices 3 indicate the positions of the hours from 1 to 12. Ring 2 also bears the names of 24 cities regularly distributed around the edge of ring 2, the names of the cities corresponding to the 24 time zones of the world. The names are etched in the upper surface of ring 2 and on the surface of an additional ring 5 having an inclined surface with respect to the plane of ring 2. The additional ring is secured to said upper surface of ring 2 by mounting feet 6.

In the specific case represented in FIG. 1, ring 2 also includes an aperture 12 arranged at 6 o'clock for displaying the date. Ring 2 is made of an opaque material, for example, a metal alloy, such as CuZn33. Concentrically with respect to ring 2, and essentially in the same plane as ring 2, there is mounted a central, preferably metal disc 7, also made of an opaque material, for example titanium, and comprising a central hole 8 for the passage of rotating arbors which carry the hour and minute hands of a watch. The diameter D3 of central disc 7 is less than the internal diameter D2 of ring 2, which leaves an annular area 9 visible between disc 7 and ring 2. Said annular area 9 is covered by a part 10 made of a transparent material, such as PMMA (poly methyl methacrylate) or sapphire.

Figure 3:
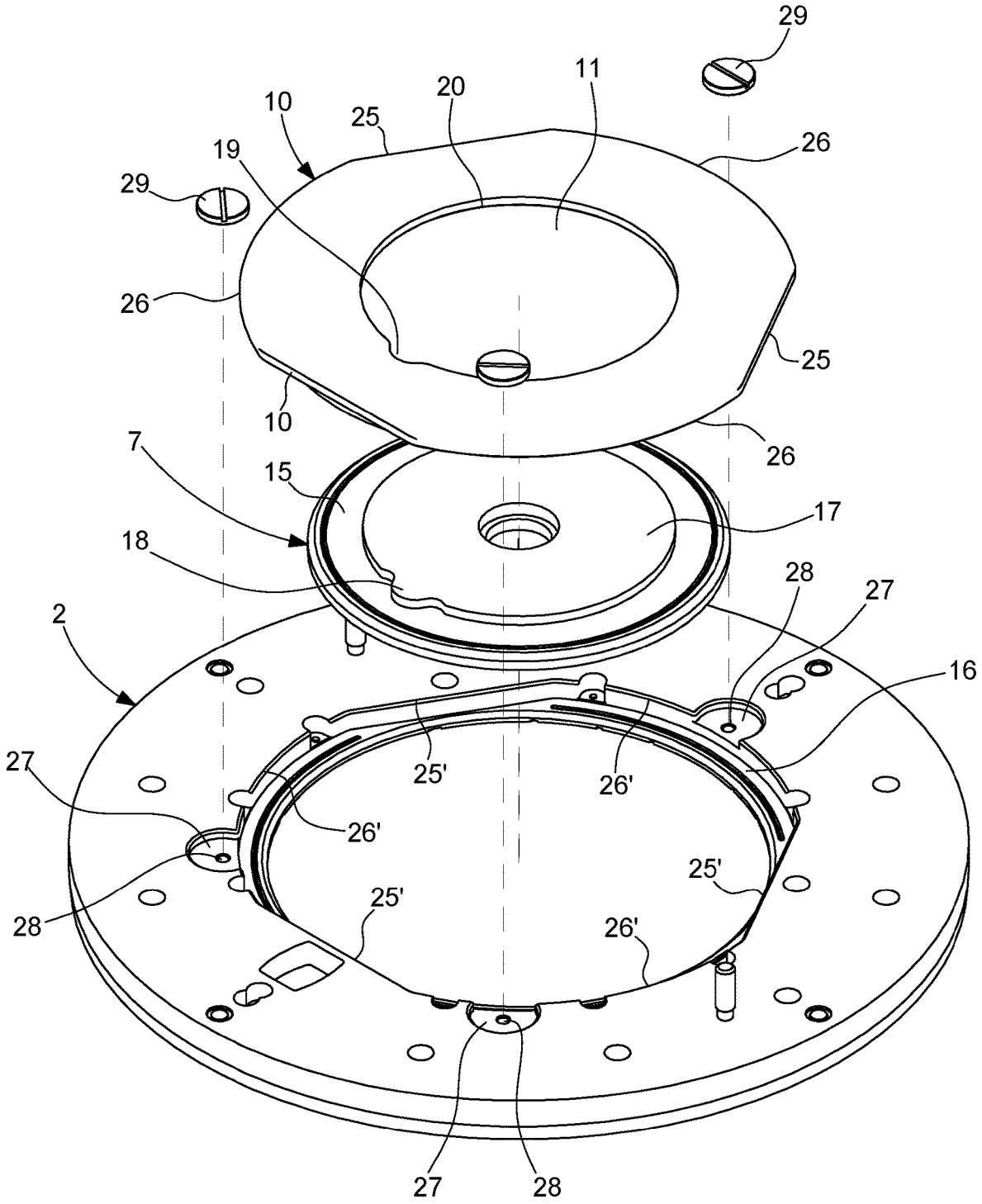
FIG. 3 represents an exploded view of the components of the dial shown in FIGS. 1 and 2.

In the specific case represented in the Figures, transparent part 10 also takes the form of a flat ring and has a central opening 11 positioned concentrically with respect to central disc 7 (FIG. 3). Opening 11 is dimensioned such that transparent part 10 covers an annular portion 15 located on the periphery of the lower surface of disc 7. On the opposite side to opening 11 in the radial direction, transparent part 10 covers an annular portion 16 which is on the inner periphery of the lower surface of ring 2. Transparent part 10 is bonded to said surface portions 15 and 16, so as to keep ring 2 and disc 7 secured to each other. Seen in a plan view in FIG. 1, dial 1 thus comprises an opaque ring 2, an opaque central disc 7, and an annular aperture between disc 7 and ring 2.

The exploded view of FIG. 2 reveals the specific features of this embodiment. It is seen that, on its lower surface, central disc 7 is provided with a circular portion 17 extending in relief with respect to portion 15 which is covered by transparent part 10. The diameter of relief portion 17 corresponds to the diameter of opening 11, allowing transparent part 10 to be positioned around relief portion 17. Further, relief portion 17 has a radial protrusion 18, configured to engage in a radial notch 19 arranged in inner edge 20 of transparent part 10, such that the assembly of transparent part 10 to disc 7 is only possible in one specific angular position of transparent part 10 with respect to disc 7.

It is also seen that the outer edge of transparent part 10 includes three straight portions 25 arranged at equal angular distances around the periphery of part 10, while the rest of the edge consists of three curved portions 26 which are arcs of a circle. Annular portion 16 of ring 2, which will be covered by transparent part 10, is indented with respect to the back surface of ring 2. Said annular portion 16 is also provided with complementary straight portions 25' and curved portions 26' which correspond to the straight and curved portions 25, 26 of transparent part 10, allowing transparent part 10 to be positioned inside indented portion 16 by aligning straight portions 25, 25' and curved portions 26, 26'. In this embodiment, the lower surface of ring 2 further comprises hollow areas 27 located on the periphery of portion 16 and provided with threaded holes 28 arranged at the bottom of said areas 27. Holes 28 are configured to receive mounting screws 29 designed to attach or participate in the attachment of transparent part 10 to ring 2. Attachment is realized by the heads of mounting screws 29, which fit into hollow areas 27, extending over the edge of part 10 when screws 29 are tightened, to attach part 10 to ring 2.

The assembly of dial 1 shown in the Figures is preferably carried out in two steps. First, transparent part 10 is assembled on central disc 7, by aligning protrusion 18 and notch 19 and by placing part 10 around relief portion 17 and in contact with surface portion 15, after applying an adhesive to at least one of the contact surfaces. An adhesive that can be used for a titanium disc 7 and a PMMA transparent part 10 is APM Technica Epsilon 2103 adhesive. The assembly formed by part 10 and disc 7 is then fixed to the indented surface portion 16 of ring 2, by applying another adhesive to at least one of the contact surfaces of transparent part 10 and of portion 16 of ring 2. Next, mounting screws 29 are tightened in threaded holes 28, preferably after the application of an adhesive to the surface of hollow areas 27 in which the screw heads will be housed.

The adhesive used between transparent part 10 and ring 2 may be of the same type as the adhesive used between part 10 and central disc 7. Alternatively, a weaker adhesive is used between transparent part 10 and ring 2 than between part 10 and disc 7. A 'weaker' adhesive means an adhesive which provides lower adhesion when the assembly is subject to a determined shock.

According to yet another embodiment, transparent part 10 is not bonded to ring 2 but is attached to ring 3 simply by mounting screws 29.

According to yet another embodiment, mounting screws 29 are omitted and transparent part 10 is bonded to disc 7 and to ring 2. In this latter embodiment, the adhesive used between transparent part 10 and ring 2 can be as strong as the adhesive used between part 10 and disc 7, or weaker.

The embodiments in which a weaker adhesive is used between transparent part 10 and ring 2 than between part 10 and disc 7, or in which transparent part 10 is attached to ring 2 simply by mounting screws 29, have the advantage of improving the shock resistance of the dial, owing to the fact that the deformability of transparent part 10 increases compared to ring 2. Dome-shaped deformation of the dial ('umbrella effect'), in particular, which may cause the hands to come loose, is limited in the event of shocks.

Figure 4:
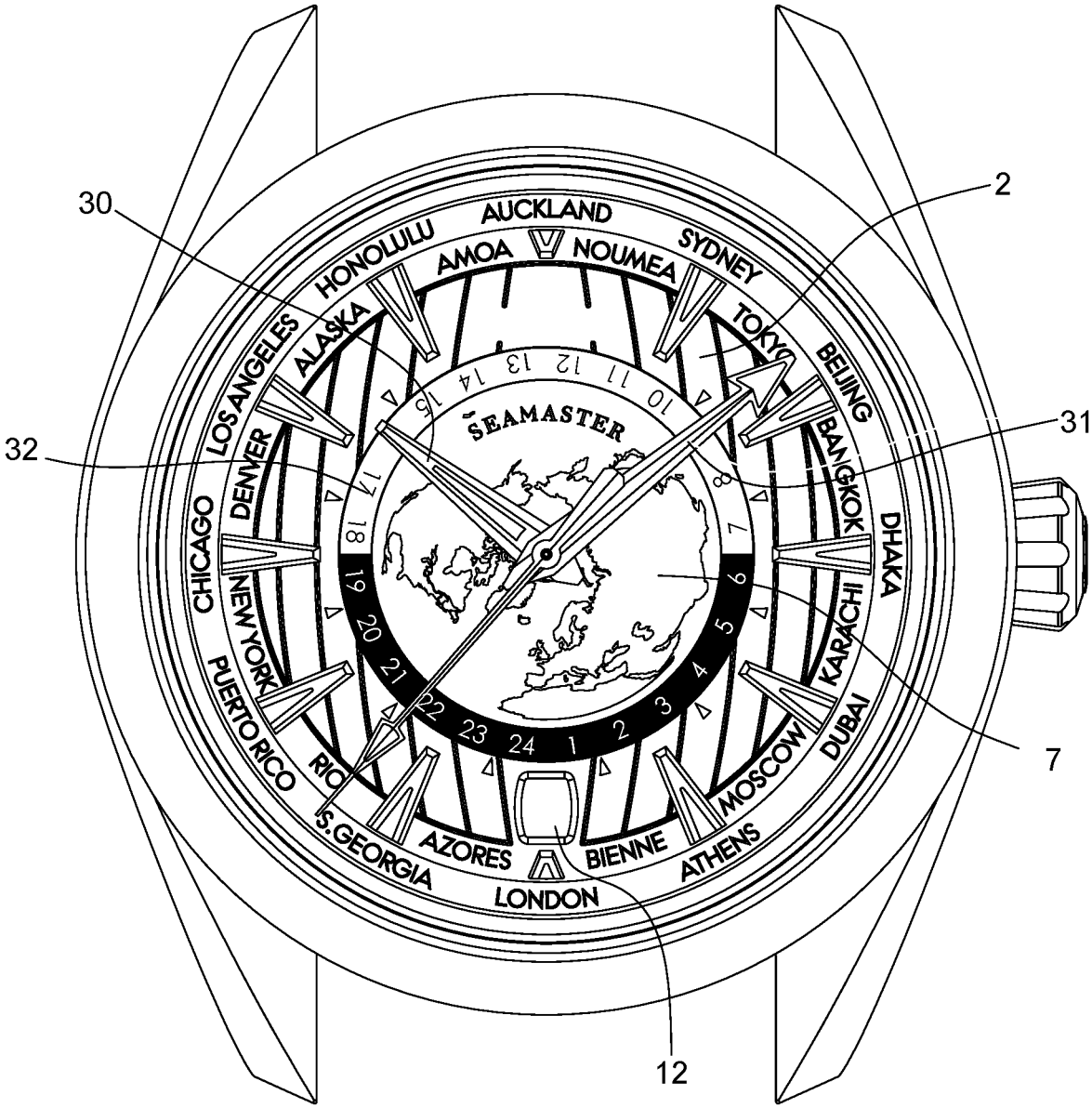
FIG. 4 represents a watch equipped with the dial represented in FIG. 1.

A watch provided with the dial described above is represented in FIG. 4. The watch has hour and minute hands 30 and 31, which move above the dial to indicate the time and which are driven in rotation in a conventional manner by a timepiece movement (not represented), and an annular twenty-four hour disc 32, also driven in rotation by said movement which moves underneath dial 1. Twenty-four hour disc 32 is provided with 24 markings regularly distributed over its surface. The markings are aligned with the annular area between central disc 7 and ring 2, so that these markings are seen through the aperture created by transparent part 10. Twenty-four hour disc 32 is driven and corrected by known mechanisms generally simultaneously with the hour and minute hands. The watch also includes an annular date disc aligned with aperture 12, also driven in a known manner. Central disc 7 can also be provided with a decoration, by etching for example. Typically, central disc 7, made, for example, of titanium, can be decorated by means of an ultrashort pulse laser, typically a femtosecond laser, which makes it possible to sculpt nanostructures on the surface of the disc which selectively reflect certain wavelengths of visible light and thus allow colouring.

Those skilled in the art understand that variants of certain features of the dial described above are within the scope of the invention. Transparent part 10 could take the form of a solid disc instead of a ring. Instead of, or in addition to adhesives and mounting screws, other means of attachment could be used to secure transparent part 10 to disc 7 and/or to ring 2. Transparent part 10 could be fixed to the upper surface instead of the lower surface of disc 7 and/or of ring 2.

The invention claimed is:

1. A dial for a timepiece, the dial comprising:

a flat ring made of opaque material, having an external diameter and an internal diameter, the ring having an upper surface and a lower surface;

a central disc made of opaque material having a diameter which is less than the internal diameter of the ring, the central disc being positioned concentrically with respect to the ring and essentially coplanar with the ring, such that an annular area is created between the disc and the ring, the central disc having an upper surface and a lower surface respectively oriented like the upper surface and the lower surface of the flat ring; and a part made of transparent material which covers the annular area and which is fixed to the central disc and to the ring, in order to join the ring and the central disc to each other, while creating an annular aperture between the disc and the ring, wherein the transparent part covers at least one portion of the upper surface of the central disc from above or the lower surface of the central disc from below.

2. The dial according to claim 1, wherein the transparent part is fixed to the central disc by bonding the transparent part to said surface portion.

3. The dial according to claim 2, wherein said surface portion of the central disc covered by the transparent part is an annular portion which is on the periphery of the upper or lower surface of the central disc.

4. The dial according to claim 3, wherein the transparent part has a flat annular shape, said part comprising a central opening positioned concentrically with respect to the central disc, and dimensioned such that the transparent part covers said annular portion on the periphery of the upper or lower surface of the central disc.

5. The dial according to claim 4, wherein the central disc includes a relief portion surrounded by the annular portion, the relief portion being dimensioned such that the opening is positioned around said relief portion.

6. The dial according to claim 5, wherein the opening and the relief portion are respectively provided with a radial protrusion and a radial notch or vice versa, the protrusion being configured to engage in the notch, in order to only allow assembly of the transparent part to the central disc in one angular position of said part with respect to the central disc.

7. The dial according to claim 1, wherein the transparent part covers at least one portion of the upper or lower surface of the ring, and wherein the transparent part is fixed to the ring by the bonding and/or screwing of the transparent part to said surface portion of the ring.

8. The dial according to claim 7, wherein said surface portion of the ring covered by the transparent part is an annular portion which is on the inner periphery of the surface of the ring.

9. The dial according to claim 8, wherein said annular portion is in an indented position with respect to the rest of said surface of the ring.

10. The dial according to claim 9, wherein the outer edge of the transparent part has geometric elements which allow angular alignment of the transparent part with respect to the ring, and wherein said annular portion includes alignment elements which correspond to the geometric elements on the outer edge of the transparent part.

11. The dial according to claim 8, wherein the transparent part is fixed to the ring by at least a plurality of mounting screws comprising screw heads which extend over the outer edge of the transparent part.

12. The dial according to claim 1, wherein:

the transparent part is fixed to the central disc by a first adhesive, the transparent part is fixed to the ring by at least a second adhesive, and the second adhesive is weaker than the first adhesive.

13. The dial according to claim 1 wherein:

the transparent part is fixed to the central disc by a first adhesive, and the transparent part is fixed to the rings by screws, without the application of adhesive.

14. The dial according to claim 1, wherein the ring comprises on its upper surface a plurality of names of global locations which represent the time zones of the world.

15. A timepiece comprising a dial, the dial comprising:

a flat ring made of opaque material, having an external diameter and an internal diameter, the ring having an upper surface and a lower surface;

a central disc made of opaque material having a diameter which is less than the internal diameter of the ring, the central disc being positioned concentrically with respect to the ring and essentially coplanar with the ring, such that an annular area is created between the disc and the ring, the central disc having an upper surface and a lower surface respectively oriented like the upper surface and the lower surface of the flat ring; and a part made of transparent material which covers the annular area and which is fixed to the central disc and to the ring, in order to join the ring and the central disc to each other, while creating an annular aperture between the disc and the ring, wherein the transparent part covers at least one portion of the upper surface of the central disc from above or the lower surface of the central disc from below.

16. The timepiece according to claim 15, wherein the dial comprises on the upper surface of the ring a plurality of names of global locations which represent the time zones of the world, and wherein the timepiece includes beneath the dial a twenty-four hour disc for marking the universal time with a plurality of markings distributed over the twenty-four hour disc, and wherein the markings are aligned with the annular area between the disc and the ring of the dial.

* * * * *